US011559446B2

(12) United States Patent
Steiner

(10) Patent No.: US 11,559,446 B2
(45) Date of Patent: Jan. 24, 2023

(54) ANTI-ROLLBACK BRAKING SYSTEM FOR WHEELCHAIRS

(71) Applicant: Gerald M. Steiner, Las Vegas, NV (US)

(72) Inventor: Gerald M. Steiner, Las Vegas, NV (US)

( * ) Notice: Subject to any disclaimer, the term of this patent is extended or adjusted under 35 U.S.C. 154(b) by 516 days.

(21) Appl. No.: 16/676,190

(22) Filed: Nov. 6, 2019

(65) Prior Publication Data

US 2021/0128380 A1 May 6, 2021

(51) Int. Cl.
*A61G 5/10* (2006.01)

(52) U.S. Cl.
CPC ..... *A61G 5/101* (2013.01); *A61G 5/1018* (2013.01); *A61G 5/1035* (2013.01)

(58) Field of Classification Search
CPC .... A61G 5/1086; A61G 5/101; A61G 5/1018; A61G 5/1035
See application file for complete search history.

(56) References Cited

U.S. PATENT DOCUMENTS

| | | | | |
|---|---|---|---|---|
| 5,401,044 A * | 3/1995 | Galumbeck | A61G 5/128 188/2 F |
| 6,253,880 B1 * | 7/2001 | Faber | A61G 5/1035 280/250.1 |
| 6,655,503 B1 * | 12/2003 | Moody | B60T 1/04 280/250.1 |
| 7,320,473 B1 * | 1/2008 | Bennett | B60T 7/104 188/2 F |
| 2020/0146907 A1 * | 5/2020 | Stakne | A61G 5/101 |

* cited by examiner

*Primary Examiner* — Jacob D Knutson
*Assistant Examiner* — Harold Eric Pahlck, III
(74) *Attorney, Agent, or Firm* — The Thornton Firm, LLC

(57) ABSTRACT

A wheelchair comprising a seat back, a seat bottom, a frame, two front wheel assemblies, two drive wheels, two wheelchair wheels, and an anti-rollback wheelchair braking system consisting of two braking units, each unit comprising a housing cylinder body cap, a housing cylinder body, a housing cylinder mounting assembly, a wheelchair mounting assembly, rotatable toggle clamp direction selection lever, an anti-rollback, one-way, brake assembly, and a toggle clamp assembly for engaging the said anti-rollback, one-way, brake assembly with a wheelchair wheel. A parking brake assembly may also be included. The invention may be manufactured and sold as a whole wheelchair assembly or a retrofit kit for standard wheelchairs.

15 Claims, 9 Drawing Sheets

ANTI-ROLLBACK BRAKING SYSTEM FOR WHEELCHAIRS

CROSS-REFERENCE TO RELATED APPLICATIONS

Not applicable

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

BACKGROUND OF THE INVENTION

1. Field of the Invention

One or more embodiments of the invention generally relate to wheelchairs. More particularly, embodiments of the invention relate to wheelchairs employing an anti-rollback braking system.

2. Description of the Related Art

Standard wheelchairs are well known and understood in the art. A standard, self-propelled manual wheelchair typically incorporates a frame, a seat, a footrest assembly including one or two footplates (footrests), two swivel caster wheels at the front, and two large wheels at the back. The two large wheels at the back may resemble a bicycle wheel in that they have a hub assembly and spokes radiating from the hub assembly to the rim. A tire is generally affixed to the rim. In contrast to a bicycle wheel, though, the larger rear wheels usually have push-rims of slightly smaller diameter mounted to the rear wheels and projecting just beyond the tire. The push rims allow the user to maneuver the chair by pushing on them without requiring them to grasp the tires. Standard wheelchairs often have two push handles at the upper rear of the frame to allow for manual propulsion by a second person.

In a standard wheelchair, a user revolves the rear wheels by applying force to the push rims which are attached to the rear wheels using his or her hands to move the wheelchair. Alternatively, another person may push or pull the wheelchair from the back. Rigid-framed chairs can be made to order, suiting both the specific size of the user and their needs and preferences around areas such as the stability around the rear axle.

Standard manual wheelchairs come in two major varieties, folding or rigid. Folding chairs are generally low-end designs, whose predominant advantage is being able to fold, generally by bringing two mirror-image sides together. However, this is largely an advantage for part-time users who may need to store the wheelchair more often than use it. Rigid wheelchairs, which are increasingly preferred by full-time and active users, have permanently welded joints and many fewer moving parts. This reduces the energy required to push the chair by eliminating many points where the chair would flex and absorb energy as it moves. Welded rather than folding joints also reduce the overall weight of the chair. Rigid chairs typically feature instant-release rear wheels and backrests that fold down flat, allowing the user to dismantle the chair quickly for storage in a car. The wheels of folding chairs may be permanently attached, but those for rigid chairs are commonly fitted with quick-release axles activated by depressing a button or releasing a lever at the hub.

Many rigid models are now made with ultralight materials such as aircraft-grade aluminum and titanium, and wheelchairs of composite materials such as carbon-fiber have started to appear. Ultra-lightweight rigid wheelchairs are commonly known as 'active user chairs' as they are ideally suited to independent use. Another innovation in rigid chair design is the installation of shock absorbers, which cushion the bumps over which the chair rolls. These shock absorbers may be added to the front wheels, to the rear wheels, or both. Rigid chairs also have the option for their rear wheels to have a camber, or tilt, which angles the tops of the wheels in toward the chair. This allows for more mechanically efficient propulsion by the user and also makes it easier to hold a straight line while moving across a slope. Sport wheelchairs often have large camber angles to improve stability.

All major varieties of wheelchair can be highly customized for the user's needs. Such customization may encompass the seat dimensions, height, seat angle, footplates, leg rests, front caster outriggers, adjustable backrests and controls. Various optional accessories are available, such as anti-tip bars or wheels, safety belts, adjustable backrests, tilt and/or recline features, extra support for limbs or head and neck, holders for crutches, walkers or oxygen tanks, drink holders, and mud and wheel-guards as clothing protectors. Because wheelchair frames typically have the same or similar dimensions, aftermarket parts are readily available for either customization or repair.

Manually propelled wheelchairs equipped with various forms of brakes or control devices are known in the prior art. Standard wheelchairs generally have lever action brakes that engage a brake pad with the tire surface of the rear wheelchair wheels; however, such brakes are, in general, a parking brake with in-motion braking provided by a user gripping a wheelchair wheel's push rims. Such lever brakes are often difficult to reach for an infirmed wheelchair user. Moreover, such brakes are difficult to operate on inclined planes or hills where a user may not have the strength to maintain a wheelchair's position while applying force to the push rims.

Wheelchair brakes are also necessary for a wheelchair to remain stationary when a person attempts to sit down in and occupy the wheelchair and when the occupant attempts to stand up from and vacate the wheelchair. The natural motion of a user performing these acts imparts a force in the rearward direction on the wheelchair, which, without the benefit of an actuated parking brake, causes the wheelchair to move backwards and away and endangering the user. This is known as rollback.

Presently, there is a need for an improved wheelchair with an improved braking mechanism which allows the user to more efficiently slow and lock a wheelchair in place. There also exists a need for a wheelchair retrofit kit which may include an improved braking mechanism. Finally, there exists a need for a wheelchair mechanism which allows a user to maintain a wheelchair's position while climbing hills and/or inclined planes without having to strenuously hold the wheelchair's push rims.

SUMMARY

The present invention fulfils the long felt need for an improved wheelchair with an improved braking mechanism which allows the user to more efficiently slow and lock a wheelchair in place. The present invention may be embodied in a wheelchair or in a wheelchair retrofit kit which may include an improved anti-rollback wheelchair braking system for wheelchairs.

It is an object of the present invention to provide a more efficient and ergonomic braking mechanism for standard wheelchairs.

It is a further object of the present invention to provide an anti-rollback mechanism configurable to standard wheelchairs.

It is further object of the present invention to provide a wheelchair mechanism which allows a user to maintain a wheelchair's position while climbing hills and/or inclined planes without having to strenuously hold the wheelchair's push rims.

It is another objective that the present invention may be implemented as a new type of wheelchair or it may be implemented as an aftermarket retrofit kit which may be installed on any standard wheelchair. Implemented as a retrofit kit, the present invention may be installed using the existing frame, wheels, hub and axle of a standard wheelchair. The present invention is designed to be simple in both design and use.

Embodiments of the present invention include a wheelchair comprising a seat back, a seat bottom, a frame, two front wheel assemblies, two drive wheels, two wheelchair wheels, and an anti-rollback wheelchair braking system consisting of two braking units, each unit comprising a housing cylinder body cap, a housing cylinder body, a housing cylinder mounting assembly, a wheelchair mounting assembly, rotatable toggle clamp direction selection lever, an anti-rollback, one-way, brake assembly, and a toggle clamp assembly for engaging the said anti-rollback, one-way, brake assembly with a wheelchair wheel.

An alternative embodiment of the present invention comprises an anti-rollback wheelchair brake kit consisting of two mirror image brake units, each unit comprising a housing cylinder body cap, a housing cylinder body, a housing cylinder mounting assembly, a wheelchair mounting assembly, rotatable toggle clamp direction selection lever, an anti-rollback, one-way, brake assembly, and a toggle clamp assembly for engaging the said anti-rollback, one-way, brake assembly with a wheelchair wheel.

Another alternative embodiment of the present invention comprises an anti-rollback wheelchair brake kit consisting of two mirror image brake units, each unit comprising a cylinder body cap, a cylinder body, a cylinder mounting assembly, a wheelchair mounting assembly, a brake surface, a power supply, a direction control assembly; and a solenoid/actuator assembly for engaging the said brake surface with a wheelchair wheel.

Embodiments of the invention may also include a parking brake mechanism consisting of a lever assembly, a toggle clamp assembly, a mounting assembly and a braking surface capable of engaging with a wheelchair wheel. Such a parking brake may be mountable on the brake units and may be used to slow and lock a wheelchair in place.

BRIEF DESCRIPTION OF THE DRAWINGS

The invention directed by way of example, and not by way of limitation, in the figures of the accompanying drawings and in which like reference numerals refer to similar elements and in which.

Figure 1:
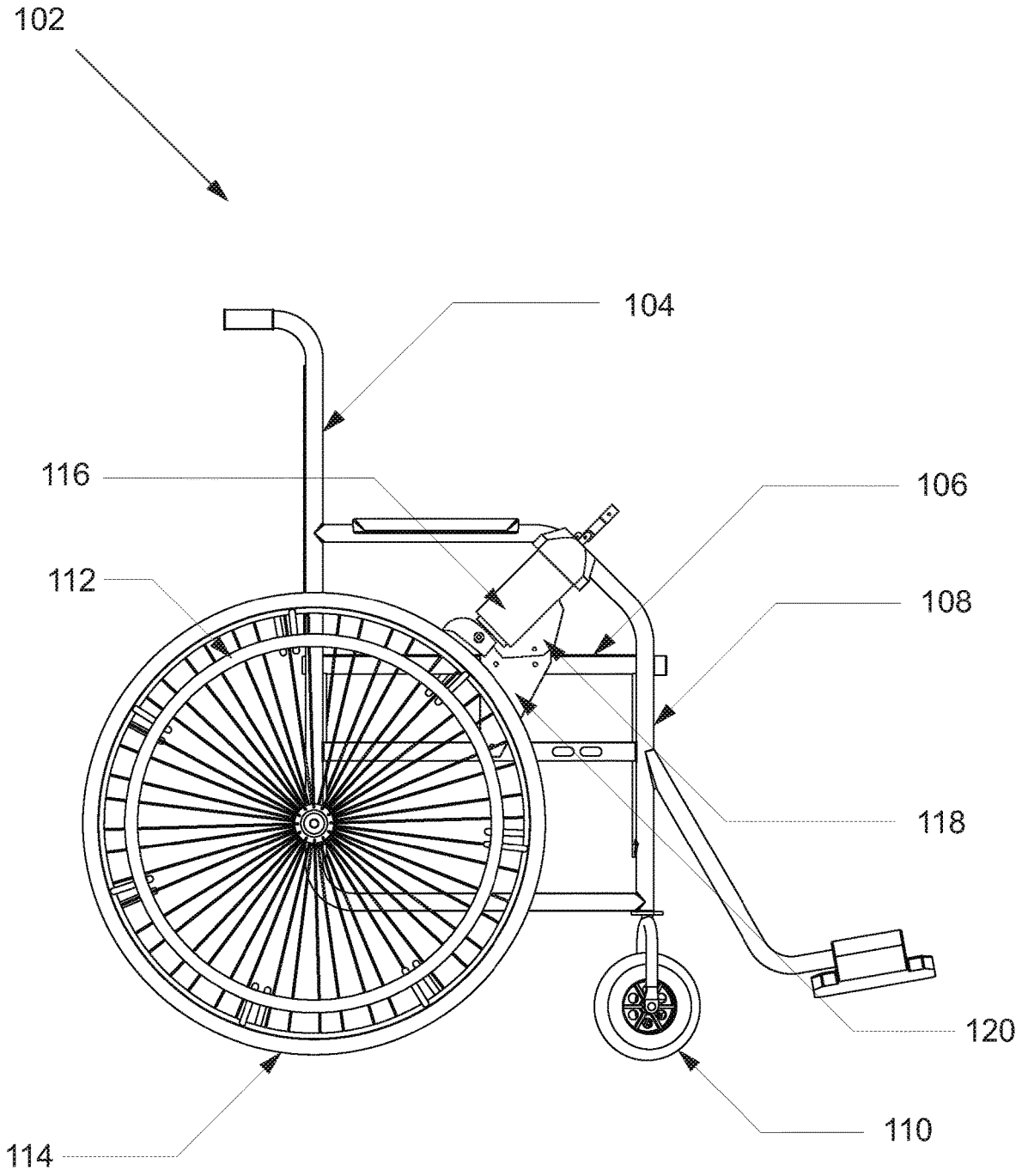
FIG. 1 is a side view of a standard wheelchair employing the anti-rollback braking system for wheelchairs.

Unless otherwise indicated illustrations in the figures are not necessarily drawn to scale.

DETAILED DESCRIPTION OF THE PREFERRED EMBODIMENTS

Terminology used herein is used for the purpose of describing particular embodiments only, and is not intended to limit the scope of the present invention. It must be understood that as used herein and in the appended claims, the singular forms "a," "an," and "the" include the plural reference unless the context clearly dictates otherwise. For example, a reference to "an element" is a reference to one or more elements and includes all equivalents known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Language that may be construed to express approximation should be so understood unless the context clearly dictates otherwise.

Unless defined otherwise, all technical and scientific terms used herein have the same meanings as commonly understood by a person of ordinary skill in the art to which this invention belongs. Preferred methods, techniques, devices, and materials are described. But any methods, techniques, devices, or materials similar or equivalent to those described herein may be used in the practice or testing of the present invention. Structures described herein should also be understood to refer to functional equivalents of such structures.

References to "one embodiment," "an embodiment," "various embodiments," etc., may indicate that the embodiment(s) of the invention so described may include particular features, structures, or characteristics. However, not every embodiment necessarily includes the particular features, structures, or characteristics. Further, repeated use of the phrase "in one embodiment," or "in an exemplary embodiment," do not necessarily refer to the same embodiment although they may. A description of an embodiment with several components in communication with each other does not imply that all such components are required. On the contrary, a variety of optional components are described to illustrate the wide variety of possible embodiments of the present invention.

As is well known to those skilled in the art, many careful considerations and compromises typically must be made when designing for the optimal manufacture of a commercial implementation of such an anti-rollback braking system for wheelchairs. A commercial implementation in accordance with the spirit and teachings of the invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art.

The exemplary anti-rollback braking system for wheelchairs will now be described in detail with reference to embodiments thereof as illustrated in the accompanying drawings.

FIG. 1 is a side view of a standard wheelchair employing the anti-rollback braking system for wheelchairs. Persons having skill in the art will readily appreciate that a wheelchair consists of two mirror image sides which comprise a whole unit. Embodiments of the present invention may comprise a wheelchair 102 consisting of a seat back 104, a seat bottom 106, a frame 108, two front wheel assemblies 110, two drive wheels 112, two wheelchair wheels 114, and an anti-rollback wheelchair braking system consisting of two braking units 116. The two braking units 116 are positioned in an ergonomic manner where a user may easily engage and disengage the brakes with minimal effort. Persons skilled in the art will readily appreciate that a cylinder mounting assembly may consist of, but is not limited to, a cylinder mounting plate 118 which attaches to a chair mounting plate 120 which may attach to the frame of a standard wheelchair through various means known and appreciated in the art. Such mounting plates may assume numerous shapes and conformations to accommodate for wheelchair frames of varying makes and models.

Figure 2:
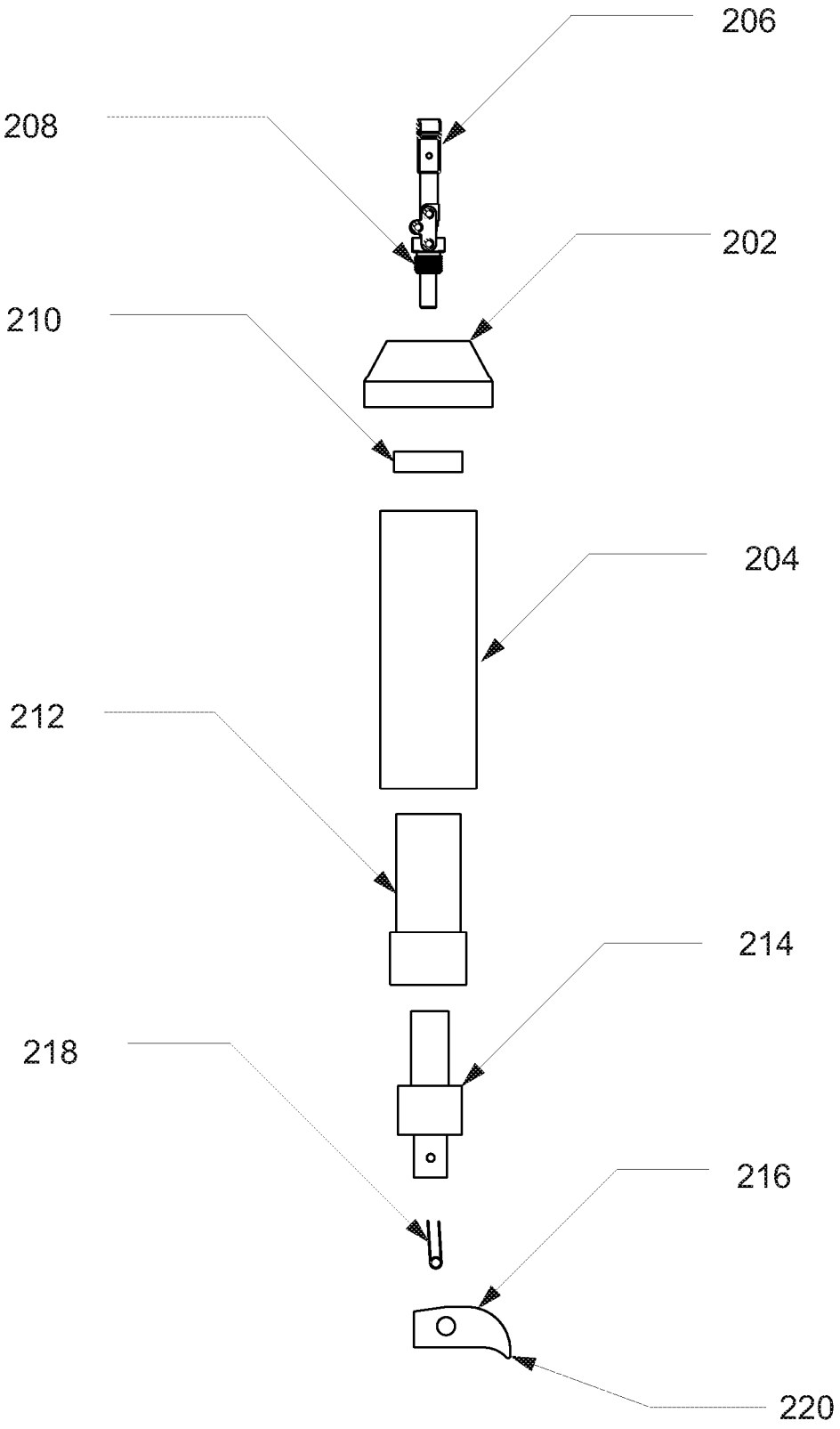
FIG. 2 is an exploded side view of an anti-rollback braking system for wheelchairs in accordance with an embodiment of the invention.

FIG. 2 is an exploded side view of a braking unit an anti-rollback braking system for wheelchairs in accordance with an embodiment of the invention. Each braking unit comprises a housing cylinder body cap 202, a housing cylinder body 204, rotatable toggle clamp direction selection lever 206, an anti-rollback, one-way, brake assembly, and a toggle clamp assembly 208 for engaging the said anti-rollback, one-way, brake assembly 216 with a wheelchair wheel. The housing cylinder body cap 202 may be made of a rigid material such as a plastic or metal and may attach to the cylinder body 204 by numerous means known and appreciated in the art. Likewise, the housing cylinder body 204 may be made of a rigid material such as a plastic or metal. In the preferred embodiment of the invention, the general shape of the housing cylinder body 204 is that of a truncated cylinder with the truncated surface used to accommodate a cylinder mounting plate which may be used to connect to a chair mounting plate. The truncated surface, or another truncated surface, may also be used to accommodate a parking brake assembly as well. Persons having skill in the art will readily appreciate that there are numerous ways to assemble the components.

The housing cylinder body cap 202 is shaped in such a manner so as to accommodate a rotatable toggle clamp direction selection lever 206. An orientation washer 210 may be used to secure the assembly in place and insure proper orientation of the toggle clamp assembly 208, toggle clamp selection lever 206 and the and anti-rollback, one-way, brake assembly 216. In the preferred embodiment of the invention, a general slot shape allows for a user to push the rotatable toggle clamp direction selection lever 206 forwards, rearwards or from one side to another. In the middle of the general cross shape is a middle position where the toggle clamp assembly for engaging the said anti-rollback, one-way, brake assembly 216 does not engage the anti-rollback, one-way, brake assembly with a wheelchair wheel. In this position, a user may rotate the selection lever 206 so as to rotate the anti-rollback, one-way, brake assembly one hundred and eighty degrees. If the user pushes the rotatable toggle clamp direction selection lever 206 forward, the lever 206 will lock into place, the anti-rollback, one-way, brake assembly 216 will engage with a wheelchair wheel thus preventing the wheelchair wheel from rolling backwards. Likewise, if a user pushes the rotatable toggle clamp direction selection lever 206 rearward, the lever will lock into place, the anti-rollback, one-way, brake assembly 216 will engage with a wheelchair wheel thus preventing the wheelchair wheel from rolling forwards. In alternative embodiments of the invention, the cap assembly 202 may be modified to allow for more functionality. For example, but not by way of limitation, a user may be able to push the rotatable toggle clamp direction selection lever 206 to either side, which will cause the lever to lock into place, and the anti-rollback, one-way, brake assembly 216 may fully engage with a wheelchair wheel thus preventing the wheelchair wheel from rolling either forwards or rearwards depending on the direction and/or position of the anti-rollback, one-way, brake assembly 216.

In one embodiment of the invention, the anti-rollback, one-way, brake assembly 216 employs a pawl mechanism which allows for one-way travel of the wheelchair wheel. The rotatable toggle clamp selection lever 206 is used to axially drive the toggle clamp assembly 208 which is connected to a toggle mount sleeve 212 which is slidingly positioned inside the housing cylinder body 204 which may connect to a mounting shaft 214 and connected to the anti-rollback, one-way brake assembly 216. Persons having skill in the art will understand that a push-pull toggle clamp may be used as the toggle clamp assembly 208. Persons having skill in the art will further appreciate that numerous push-pull toggle clamp assemblies may be fashioned, purchased on the secondary market, or employed in the making of each braking unit. In embodiments of the invention, the anti-rollback, one-way, brake assembly 216 may consist of a pawl 220 and a torsion spring assembly 218. Persons skilled in the art will readily understand that a pawl 220 may allow for one-way travel of a wheelchair wheel by engaging with the treads of a wheelchair wheel tire when the wheelchair wheel rotates in a direction opposite of the direction of the pawl 220. The pawl 220 may be shaped in numerous ways so as to optimally engage with a wheelchair wheel, and the pawl 220 may be made from numerous materials known and understood in the art. A torsion spring assembly 218 may be used to position the pawl end of the anti-rollback, one-way brake assembly 216 in such a manner where the pawl slides along the wheelchair wheel when the wheel rotates in one direction and prevents the wheel from rotating in the opposite direction. It is to be understood that other mechanisms and methods may be used to engage an anti-rollback, one-way brake assembly 216 with a wheelchair wheel. Persons having skill in the art will readily appreciate that there are numerous alternative means of connecting a toggle clamp assembly for engaging the anti-rollback, one-way, brake assembly 216 with a wheelchair wheel.

Figure 3:
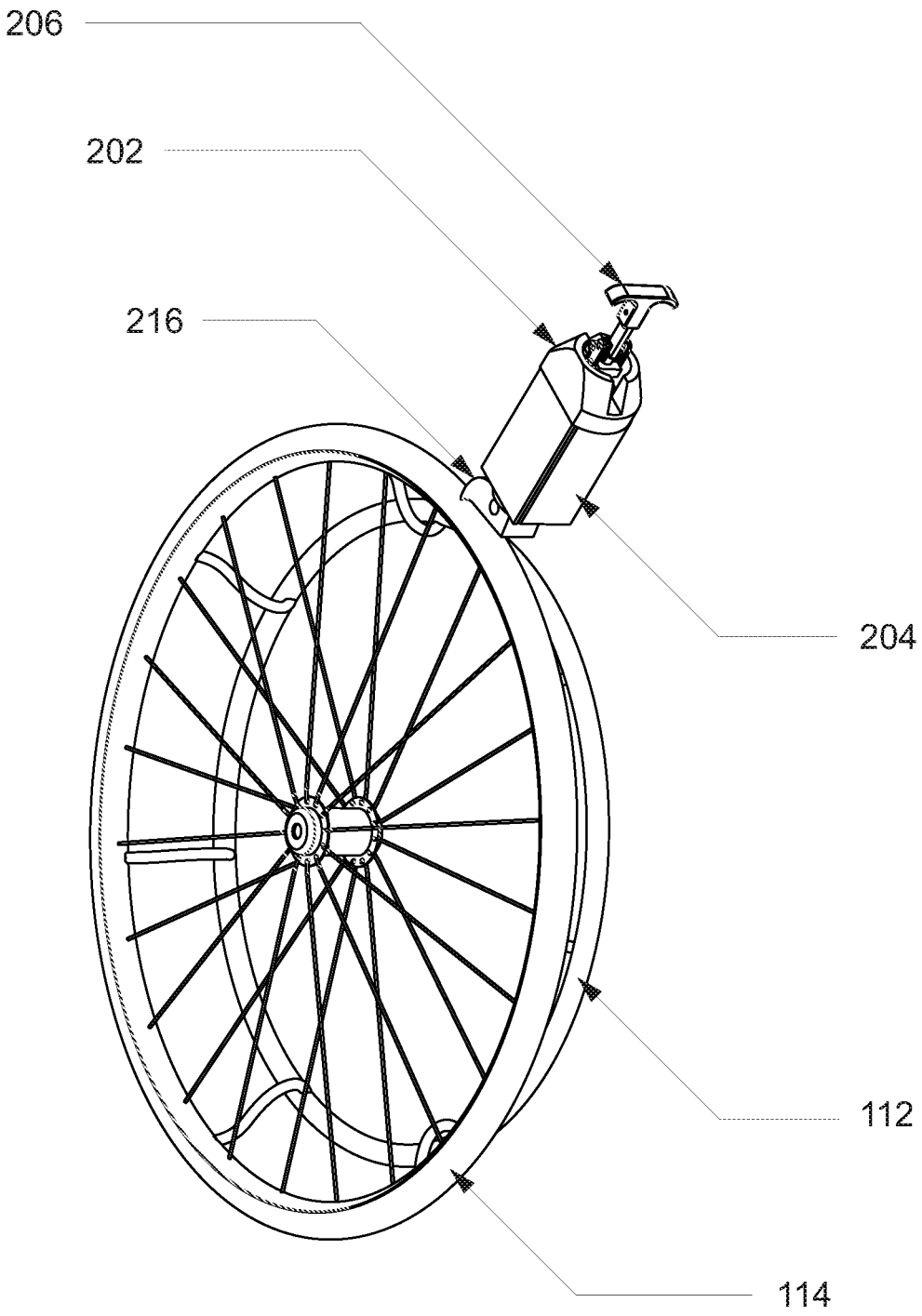
FIG. 3 is a perspective view of a braking unit and a wheelchair wheel in accordance with an embodiment of the invention.

FIG. 3 is a perspective view of a braking unit and a wheelchair wheel in accordance with an embodiment of the invention. In an embodiment of the invention, the housing cylinder body cap 202 is shaped in such a manner so as to accommodate a rotatable toggle clamp direction selection lever 206. In the preferred embodiment of the invention, a general slot shape in the housing cylinder body cap 202 allows for a user to push the rotatable toggle clamp direction selection lever 206 forwards or rearwards. In the middle of the general cross shape is a middle position where the toggle clamp assembly for engaging the said anti-rollback, one-way, brake assembly 216 does not engage the anti-rollback, one-way, brake assembly with a wheelchair wheel. If the user pushes the rotatable toggle clamp direction selection lever 206 forward, the lever will lock into place, the anti-rollback, one-way, brake assembly 216 will engage with a wheelchair wheel thus preventing the wheelchair wheel from rolling backwards. Likewise, if a user pushes the rotatable toggle clamp direction selection lever 206 rearward, the lever will lock into place, the anti-rollback, one-way, brake assembly 216 will engage with a wheelchair wheel thus preventing the wheelchair wheel from rolling forwards.

Figure 4A:
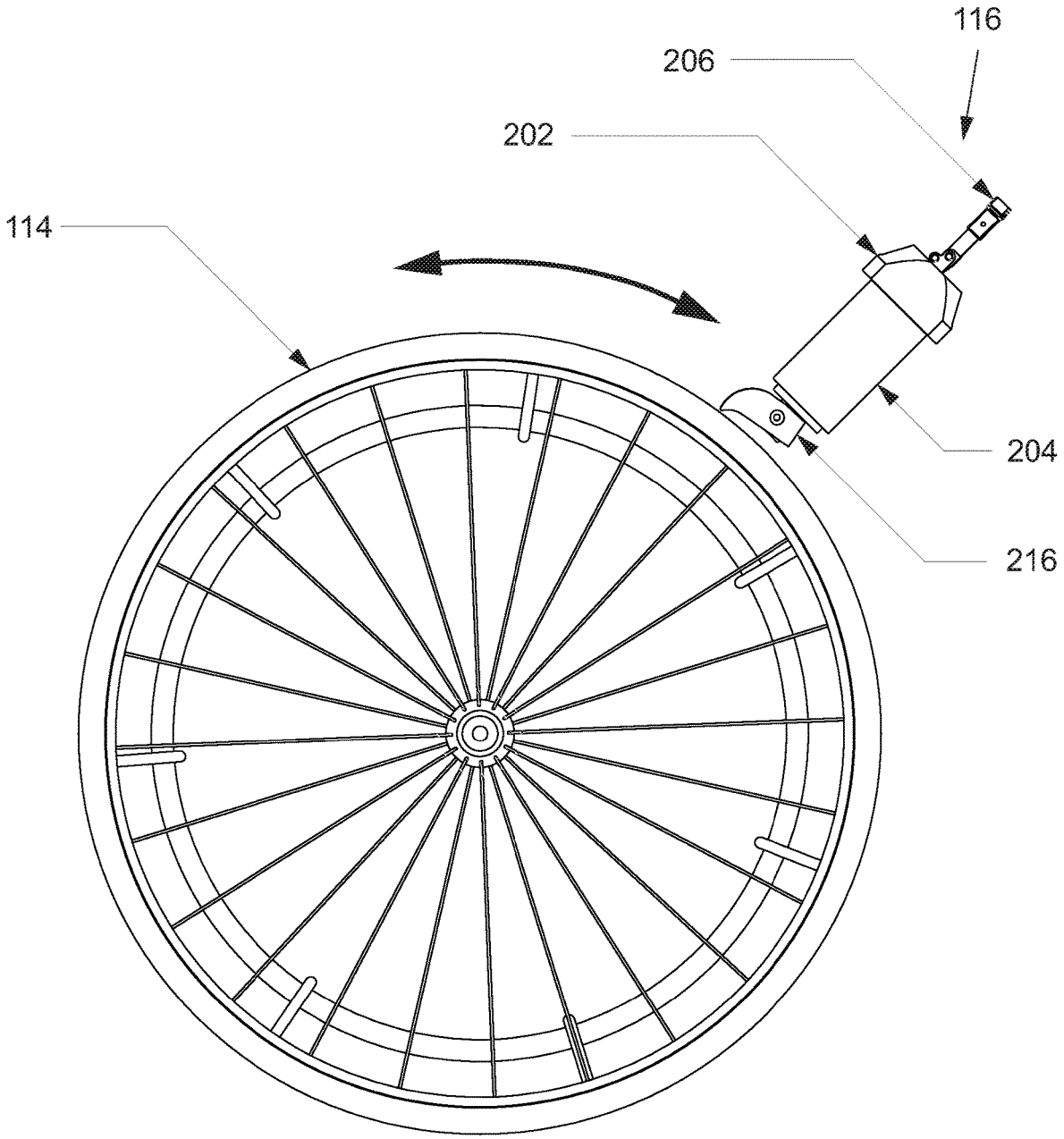
FIG. 4A is a side view of the brake unit and a wheelchair wheel of an anti-rollback braking system for wheelchairs in accordance with an embodiment of the invention.

FIG. 4A is a side view of an anti-rollback braking system for wheelchairs in accordance with an embodiment of the invention. Persons having skill in the art will readily appreciate that this view only includes the braking unit and a wheelchair wheel 114 for ease of understanding. Each braking unit 116 attaches to the frame of a standard wheelchair. Each braking unit 116 may be positioned in such a manner so as to create an ergonomically friendly configuration. The exemplary anti-rollback braking system for wheelchairs may comprise a housing cylinder body cap 202, a housing cylinder body 204, a rotatable toggle clamp direction selection lever 206, and an anti-rollback one-way brake assembly 216 for engaging the said anti-rollback, one-way, brake assembly with the tread of a tire of a wheelchair wheel. In this view, the rotatable toggle clamp direction selection lever 206 is in an up position, and an anti-rollback one-way brake assembly 216 for engaging the said anti-rollback, one-way, brake assembly with the tread of a tire of a wheelchair wheel 114 is disengaged from a wheelchair wheel. As indicated by arrows, the wheelchair wheel 114 can rotate in either direction.

Figure 4B:
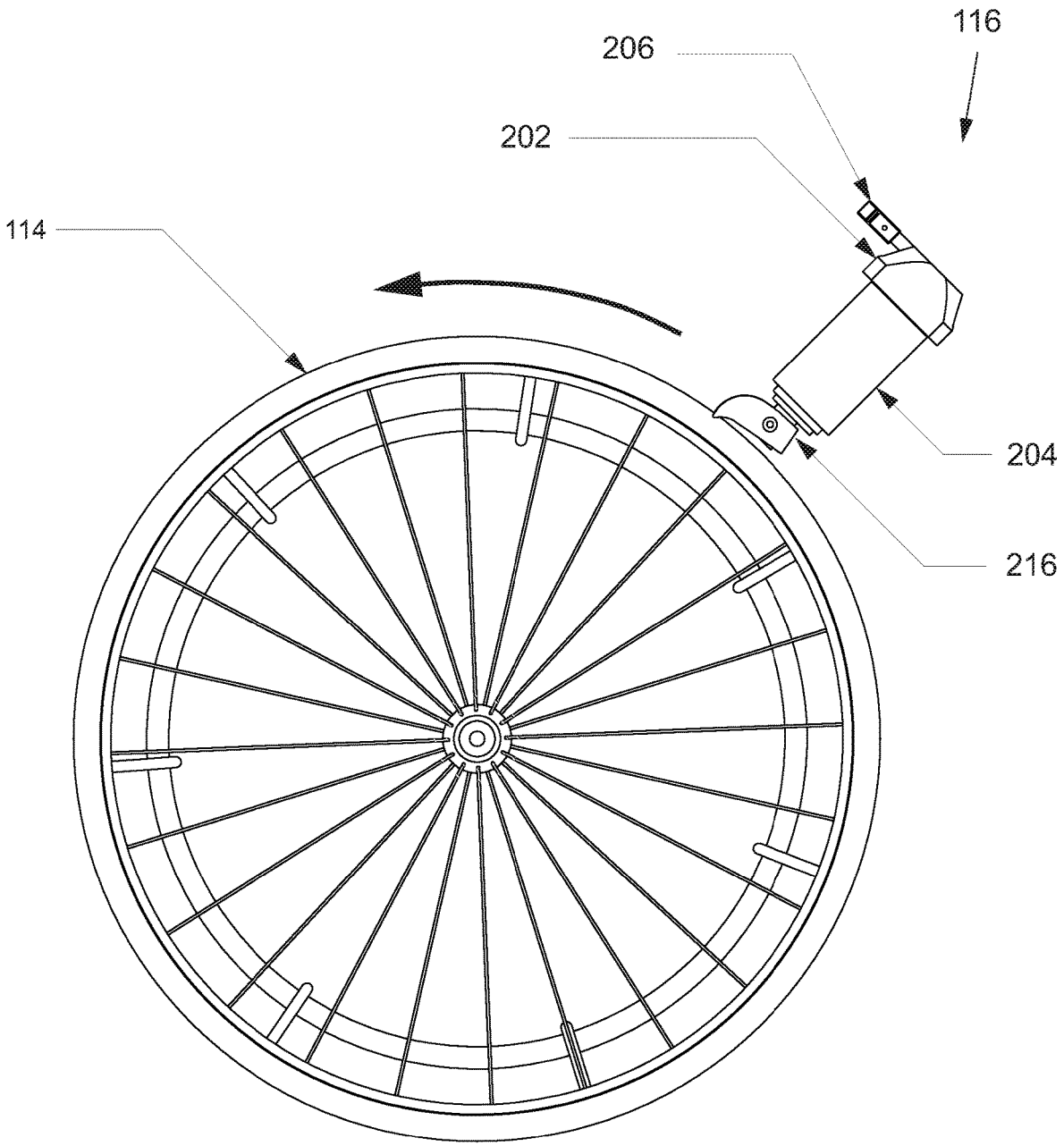
FIG. 4B is a side view of the brake unit and a wheelchair wheel of a n anti-rollback braking system for wheelchairs in accordance with an embodiment of the invention.

FIG. 4B is a side view of an anti-rollback braking system for wheelchairs in accordance with an embodiment of the invention. Persons having skill in the art will readily appreciate that this view only includes the braking unit and a wheelchair wheel for ease of understanding. Each braking unit 116 attaches to the frame of a standard wheelchair. Each braking unit 116 may be positioned in such a manner so as to create an ergonomically friendly configuration. The exemplary anti-rollback braking system for wheelchairs may comprise a housing cylinder body cap 202, a housing cylinder body 204, a rotatable toggle clamp direction selection lever 206, and an anti-rollback one-way brake assembly 216 for engaging the said anti-rollback, one-way, brake assembly with the tread of a tire of a wheelchair wheel. In this view, the rotatable toggle clamp direction selection lever 206 is in a downward position, and an anti-rollback one-way brake assembly 216 for engaging the said anti-rollback, one-way, brake assembly with the tread of a tire of a wheelchair wheel 114 is engaged with a wheelchair wheel. As indicated by the arrow, the wheelchair wheel 114 can rotate in only one direction.

Figure 5:
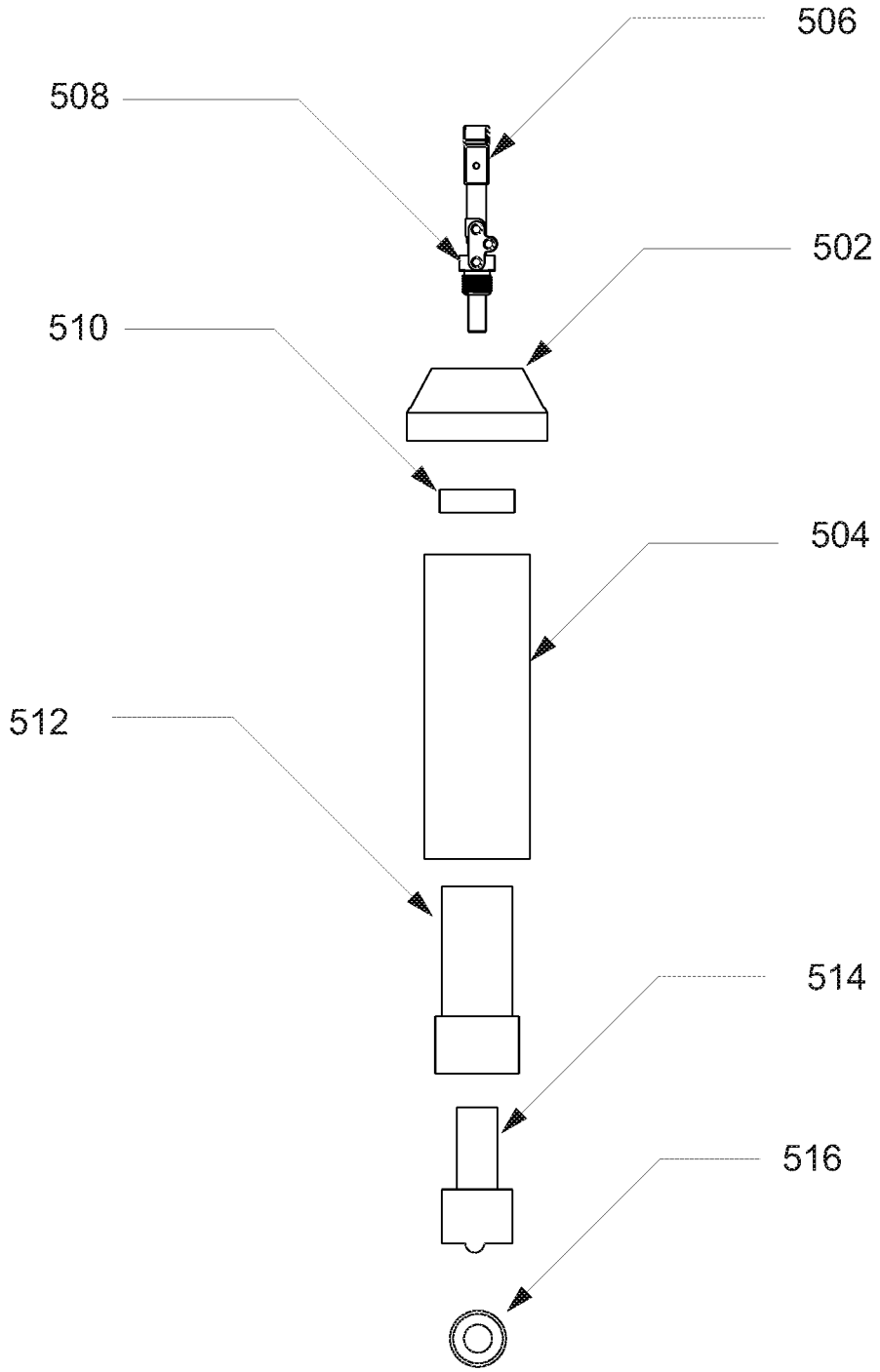
FIG. 5 is an exploded side view of an anti-rollback braking system for wheelchairs in accordance with an alternative embodiment of the invention.

FIG. 5 is an exploded side view of a braking unit an anti-rollback braking system for wheelchairs in accordance with an embodiment of the invention. Each braking unit comprises a housing cylinder body cap 502, a housing cylinder body 504, rotatable toggle clamp direction selection lever 506, an anti-rollback, one-way, brake assembly, and a toggle clamp assembly 508 for engaging the said anti-rollback, one-way, brake assembly 516 with a wheelchair wheel. The housing cylinder body cap 502 may be made of a rigid material such as a plastic or metal and may attach to the cylinder body 504 by numerous means known and appreciated in the art. Likewise, the housing cylinder body 504 may be made of a rigid material such as a plastic or metal. In the preferred embodiment of the invention, the general shape of the housing cylinder body 504 is that of a truncated cylinder with the truncated surface used to accommodate a cylinder mounting plate which may be used to connect to a chair mounting plate. The truncated surface, or another truncated surface, may also be used to accommodate a parking brake assembly as well. Persons having skill in the art will readily appreciate that there are numerous ways to assemble the components.

The housing cylinder body cap 502 is shaped in such a manner so as to accommodate a rotatable toggle clamp direction selection lever 506. An orientation washer 510 may be used to secure the assembly in place and insure proper orientation of the toggle clamp assembly 508, toggle clamp selection lever 506 and the and anti-rollback, one-way, brake assembly 516. In the preferred embodiment of the invention, a general slot shape allows for a user to push the rotatable toggle clamp direction selection lever 506 forwards or rearwards. In the middle of the general slot shape is a middle position where the toggle clamp assembly for engaging the said anti-rollback, one-way, brake assembly 516 does not engage the anti-rollback, one-way, brake assembly with a wheelchair wheel. In this position, a user may rotate the selection lever 506 so as to rotate the anti-rollback, one-way, brake assembly 516 one hundred and eighty degrees. If the user pushes the rotatable toggle clamp direction selection lever 506 forward, the lever will lock into place, the anti-rollback, one-way, brake assembly 516 will engage with a wheelchair wheel thus preventing the wheelchair wheel from rolling backwards. Likewise, if a user pushes the rotatable toggle clamp direction selection lever 506 rearward, the lever will lock into place, the anti-rollback, one-way, brake assembly 516 will engage with a wheelchair wheel thus preventing the wheelchair wheel from rolling forwards. In alternative embodiments of the invention, the cap assembly 202 may be modified to allow for more functionality. For example, but not by way of limitation, a user may be able to push the rotatable toggle clamp direction selection lever 506 to either side, which will cause the lever to lock into place, and the anti-rollback, one-way, brake assembly 516 may fully engage with a wheelchair wheel thus preventing the wheelchair wheel from rolling either forwards or rearwards depending on the direction and/or position of the anti-rollback, one-way, brake assembly 516.

In an alternative embodiment of the invention, the anti-rollback, one-way, brake assembly 516 employs a one-way wheel and bearing mechanism which, when engaged, allows for one-way travel of the wheelchair wheel. The wheel has a frictional surface which may engage with a wheelchair wheel. Persons skilled in the art will readily appreciate that such a one-way wheel and bearing mechanism may be fashioned, purchased on the secondary market, or employed in the making of each braking unit. The rotatable toggle clamp selection lever 506 is used to drive the toggle clamp assembly 508 which drives a toggle mount sleeve 512 which is slidingly positioned inside the housing cylinder body 504 and connects to a bearing housing 514 which connects the anti-rollback, one-way brake assembly 516. Persons having skill in the art will further appreciate that numerous push-pull toggle clamp assemblies may be fashioned, purchased on the secondary market, or employed in the making of each braking unit. It is to be understood that other mechanisms and methods may be used to engage an anti-rollback, one-way brake assembly 516 with a wheelchair wheel. Persons having skill in the art will readily appreciate that there are numerous alternative means of connecting a toggle clamp assembly for engaging the anti-rollback, one-way, brake assembly 516 with a wheelchair wheel.

Figure 6A:
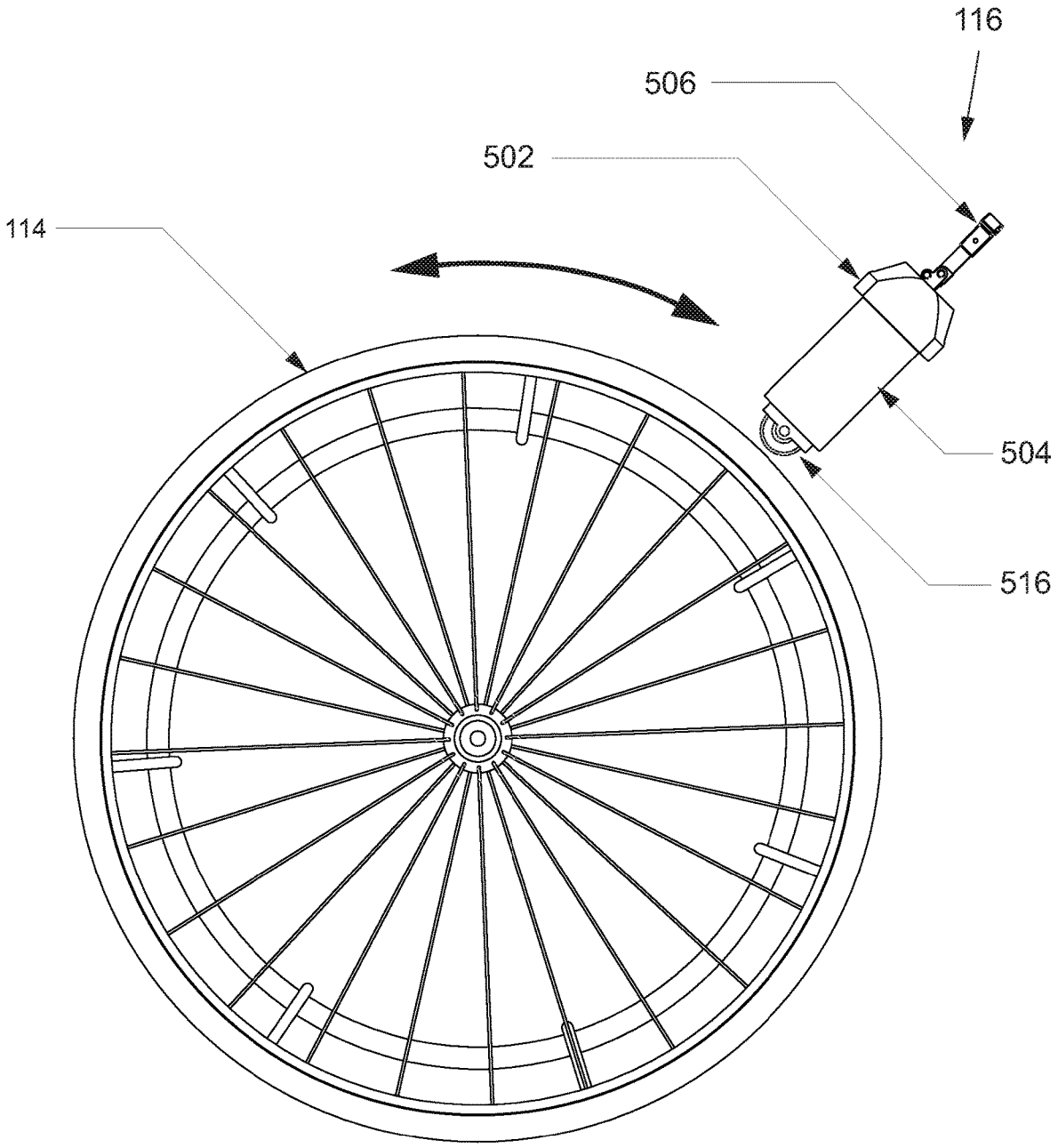
FIG. 6A is a side view of the brake unit and a wheelchair wheel of a n anti-rollback braking system for wheelchairs in accordance with an alternative embodiment of the invention.

FIG. 6A is a side view of an anti-rollback braking system for wheelchairs in accordance with an embodiment of the invention. Persons having skill in the art will readily appreciate that this view only includes the braking unit and a wheelchair wheel for ease of understanding. Each braking unit 116 attaches to the frame of a standard wheelchair. Each braking unit 116 may be positioned in such a manner so as to create an ergonomically friendly configuration. The exemplary anti-rollback braking system for wheelchairs may comprise a housing cylinder body cap 502, a housing cylinder body 504, a rotatable toggle clamp direction selection lever 506, and an anti-rollback one-way brake assembly 516 for engaging the said anti-rollback, one-way, brake assembly with the tread of a tire of a wheelchair wheel. In this view, the rotatable toggle clamp direction selection lever 506 is in an up position, and an anti-rollback one-way brake assembly 516 for engaging the said anti-rollback, one-way, brake assembly with the tread of a tire of a wheelchair wheel 114 is disengaged from a wheelchair wheel. As indicated by arrows, the wheelchair wheel 114 can rotate in either direction.

Figure 6B:
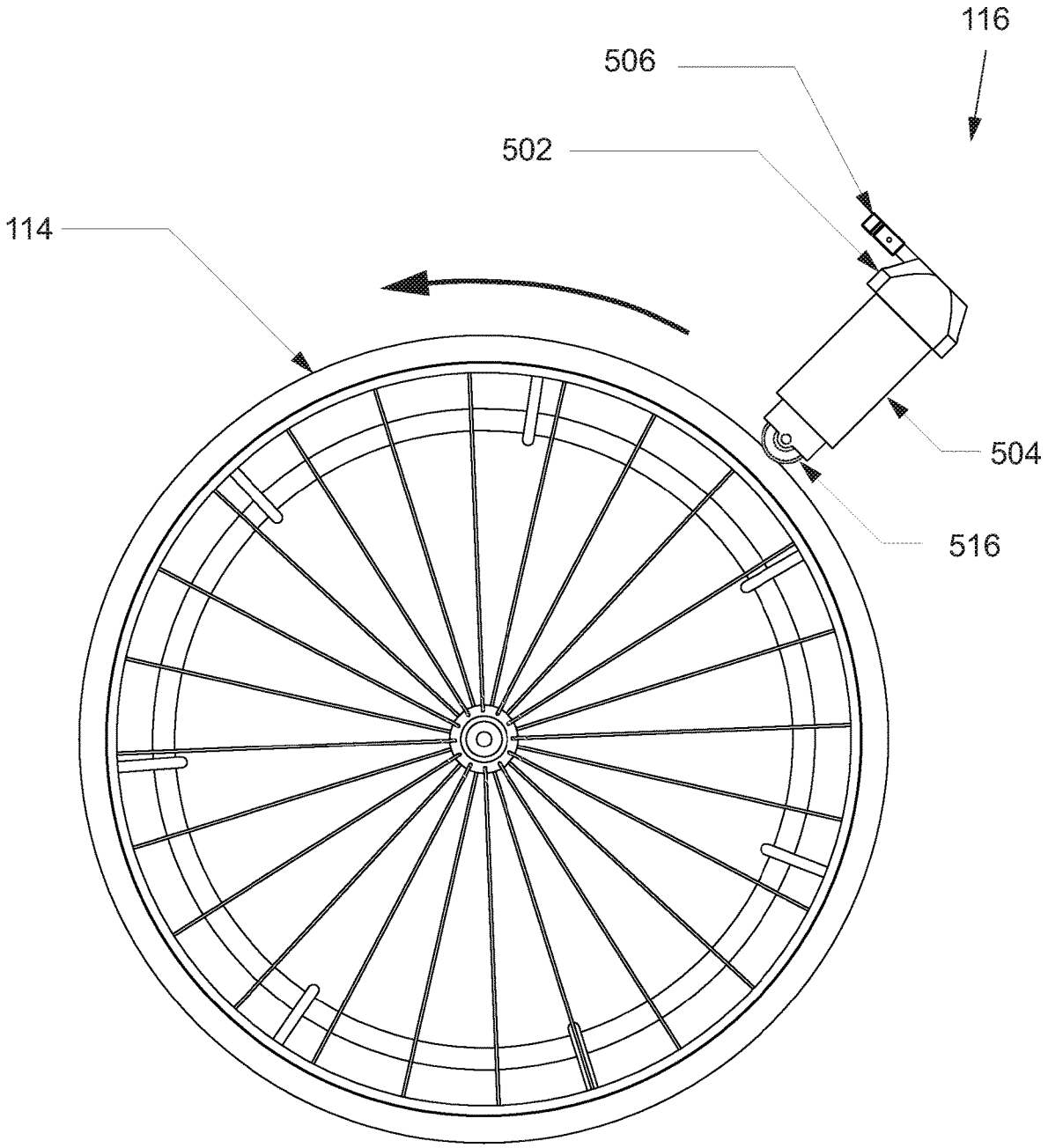
FIG. 6B is a side view of the brake unit and a wheelchair wheel of a n anti-rollback braking system for wheelchairs in accordance with an alternative embodiment of the invention.

FIG. 6B is a side view of an anti-rollback braking system for wheelchairs in accordance with an embodiment of the invention. Persons having skill in the art will readily appreciate that this view only includes the braking unit and a wheelchair wheel for ease of understanding. Each braking unit 116 attaches to the frame of a standard wheelchair. Each braking unit 116 may be positioned in such a manner so as to create an ergonomically friendly configuration. The exemplary anti-rollback braking system for wheelchairs may comprise a housing cylinder body cap 502, a housing cylinder body 504, a rotatable toggle clamp direction selection lever 506, and an anti-rollback one-way brake assembly 516 for engaging the said anti-rollback, one-way, brake assembly with the tread of a tire of a wheelchair wheel. In this view, the rotatable toggle clamp direction selection lever 506 is in a downward position, and an anti-rollback one-way brake assembly 516 for engaging the said anti-rollback, one-way, brake assembly with the tread of a tire of a wheelchair wheel 114 is engaged with a wheelchair wheel. As indicated by the arrow, the wheelchair wheel 114 can rotate in only one direction.

Figure 7:
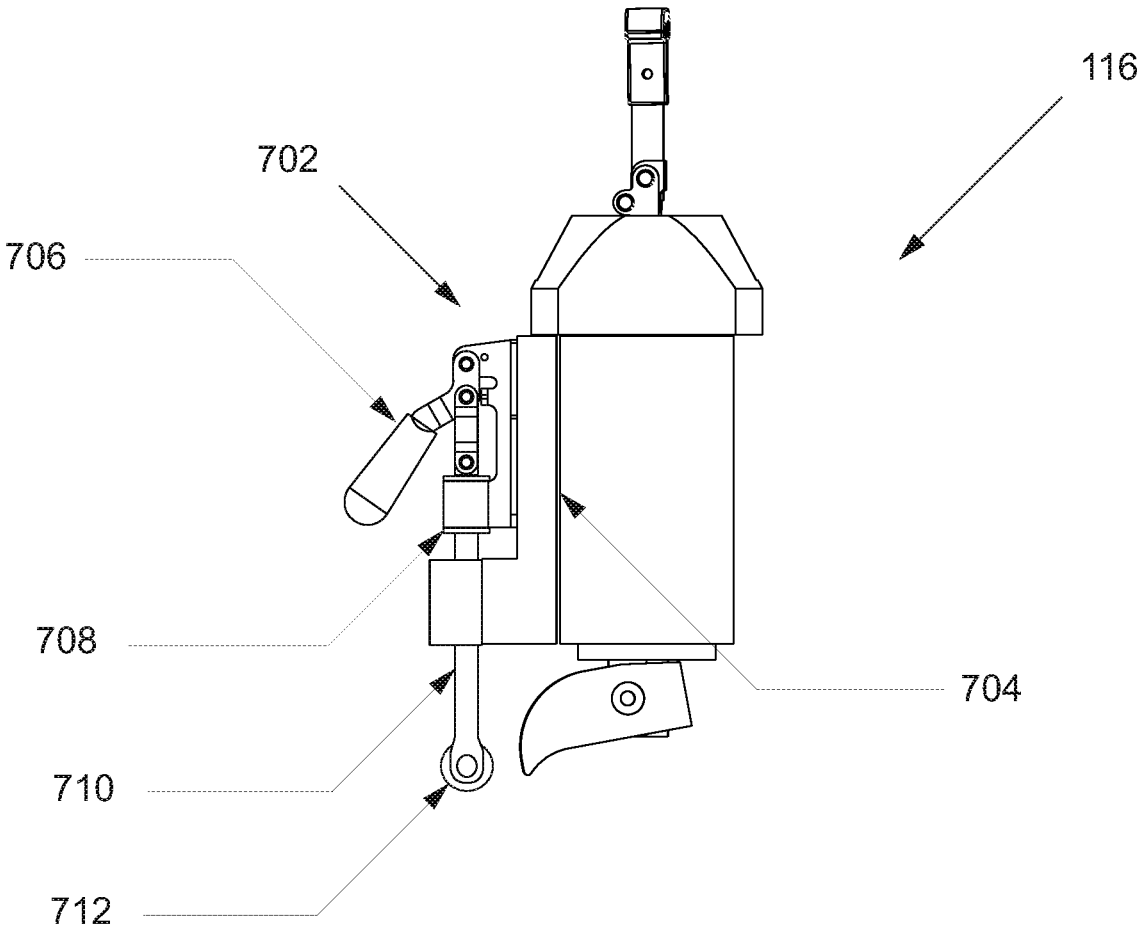
FIG. 7 is a side view the braking unit and a parking brake of an anti-rollback braking system for wheelchairs in accordance with an embodiment of the invention.

FIG. 7 is a side view the braking unit and a parking brake of an anti-rollback braking system for wheelchairs in accordance with an embodiment of the invention. In an embodiment of the invention, a parking brake 702 attaches to at least one of the braking units 116. In embodiments of the invention, the parking brake 702 consists of a lever 706, a toggle clamp assembly 708, a toggle clamp shaft 710 and a braking surface 712. Persons having skill in the art will readily appreciate that there are numerous ways to assemble the components. 712 capable of engaging with a wheelchair wheel. Furthermore, persons having skill in the art will readily appreciate that there are numerous methods and materials available to create a braking surface 712. In the preferred embodiment of the invention, the braking surface is a simple metal wheel.

The parking brake 702 may be included with or mounted to the braking unit 116 so as to form a single unit. Alternatively, the parking brake 702 may be manufactured and sold as a separate unit which may be mountable to one or more of the braking units 116.

A user may employ the parking brake 702 as either a means of slowing down a wheelchair by simply pulling the lever 706 or by fully pulling the lever and engaging the toggle clamp assembly 708. The toggle clamp assembly 708, when fully engaged, will prevent a wheelchair wheel from rotating.

In another alternative embodiment of the invention, the toggle clamp assembly may be replaced with electric solenoids and/or actuators. A computer processor may be coupled with a direction control assembly such as, but not limited to, a joystick which may serve as input/output devices. The computer processor may also be coupled to a display which may also serve as one or more input/output devices. Persons skilled in the art will readily appreciate such display devices as, but not limited to, a liquid crystal display (LCD) unit or a light emitting diode (LED) unit.

The computer processor may be coupled with a motor controller which governs the speed and force of at least one electric solenoid and/or actuator to drive the anti-rollback, one-way brake assembly into a wheelchair tier. The computer processor may also be coupled to a wheel position sensor using suitable conventional technologies known and appreciated in the art. The computer processor may be configured to a charging unit or module such as, but not limited to, a USB interface and/or charging unit. Persons having skill in the art will readily appreciate that numerous implementations of the aforementioned configuration may be used to employ such a microcontroller means. In one embodiment of the invention, the microcontroller means is located in the display unit, but such microcontroller means may be located in other locations as understood by persons having skill in the art.

Having fully described at least one embodiment of the exemplary anti-rollback braking system for wheelchairs, other equivalent or alternative methods of implementing the anti-rollback braking system for wheelchairs according to the present invention will be apparent to those skilled in the art. Various aspects of the invention have been described above by way of illustration, and the specific embodiments disclosed are not intended to limit the invention to the particular forms disclosed. The particular implementation of the anti-rollback braking system for wheelchairs may vary depending upon the particular context or application. Persons having skill in the art will readily appreciate the aforementioned components may be configured to one another by various means and may not necessarily be drawn to scale. Furthermore, based on the provided drawings, persons having skill in the art will readily understand how to make and use the present invention.

By way of example, and not limitation, anti-rollback braking system for wheelchairs described in the foregoing patent application is principally directed towards an anti-rollback braking system for a standard wheelchair. However, embodiments of the present invention may be configured to various other wheelchair types such as, but not limited to, athletic wheelchairs. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Although specific features of the invention are shown in some drawings and not others, persons skilled in the art will understand that this is for convenience. Each feature may be combined with any or all of the other features in accordance with the invention. The words "including," "comprising," "having," and "with" as used herein are to be interpreted broadly and comprehensively and are not limited to any physical interconnection. Any such numbering and lettering in itself is not intended to and should not be taken to indicate the ordering of elements and/or steps in the claims to be added at a later date.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Any amendment presented during the prosecution of the application for this patent is not a disclaimer of any claim element presented in the description or claims to be filed. Persons skilled in the art cannot reasonably be expected to draft a claim that would literally encompass each and every equivalent.

What is claimed is:

1. A wheelchair comprising:
- a seat back;
- a seat bottom;
- a frame;
- two front wheel assemblies;
- two drive wheels;
- two wheelchair wheels; and
- an anti-rollback wheelchair braking system consisting of two braking units, each unit comprising:
  - a housing cylinder body cap;
  - a housing cylinder body;
  - a wheelchair mounting assembly;
  - an anti-rollback, one-way, brake assembly, the anti-rollback, one-way brake assembly consists of a pawl mechanism which allows for one-way travel of the wheelchair wheel; and
  - a means for engaging, disengaging and rotating the said anti-rollback, one-way, brake assembly with the wheelchair wheel, the means for engaging, disengaging and rotating the anti-rollback, one-way, brake assembly with the wheelchair wheel of the anti-rollback wheelchair braking system consists of a push-pull toggle clamp, the push-pull toggle clamp drives a toggle mount sleeve which is slidingly positioned inside the housing cylinder body and connected to the anti-rollback, one-way brake assembly.

2. The wheelchair of claim 1 wherein the wheelchair mounting assembly connects each of the braking units to the frame.

3. The wheelchair of claim 1 wherein the anti-rollback, one-way brake assembly consists of a one-way wheel and bearing mechanism which allows for one-way travel of the wheelchair wheel.

4. The wheelchair of claim 1 wherein the means for engaging, disengaging and rotating the said anti-rollback, one-way, brake assembly controls the position of the anti-rollback, one-way brake assembly so as to prevent the wheelchair from moving forward, backwards or in either direction.

5. The wheelchair of claim 1 wherein the means for engaging, disengaging and rotating the anti-rollback, one-way brake assembly extends from the housing cylinder body cap in an ergonomic manner where a wheelchair user may easily engage, disengage and rotate the said anti-rollback, one-way brake assembly.

6. The wheelchair of claim 1 wherein a parking brake assembly is attached to at least one of the braking units.

7. The wheelchair of claim 6 wherein the parking brake assembly consists of a lever assembly, a toggle clamp assembly, a mounting assembly and a braking surface capable of engaging with a wheelchair wheel.

8. An anti-rollback wheelchair brake kit consisting of two mirror image brake units, each unit comprising:
- a housing cylinder body cap; A housing cylinder body;
- a wheelchair mounting assembly;
- a rotatable toggle clamp direction selection lever;
- an anti-rollback, one-way, brake assembly, the anti-rollback, one-way brake assembly consisting of a pawl mechanism which allows for one-way travel of a wheelchair wheel; and
- a toggle clamp assembly for engaging the anti-rollback, one-way, brake assembly with the wheelchair wheel, the toggle clamp assembly for engaging the anti-rollback, one-way, brake assembly with a wheelchair wheel drives a toggle mount sleeve which is slidingly positioned inside the housing cylinder body and connected to the anti-rollback, one-way brake assembly.

9. The anti-rollback wheelchair brake kit of claim 8 wherein the wheelchair mounting assembly connects each brake unit to a wheelchair frame.

10. The anti-rollback wheelchair brake kit of claim 8 wherein the anti-rollback, one-way brake assembly consists of a one-way wheel and bearing mechanism which allows for one-way travel of the wheelchair wheel.

11. The anti-rollback wheelchair brake kit of claim 8 wherein the means for engaging, disengaging and rotating the said anti-rollback, one-way, brake assembly is a toggle clamp lever assembly and extends from the housing cylinder body cap in an ergonomic manner and controls the position of the anti-rollback, one-way brake assembly so as to prevent the wheelchair from moving forward, backwards or in either direction.

12. The anti-rollback wheelchair brake kit of claim 8 wherein a parking brake assembly is attached to at least one of the braking units.

13. The anti-rollback wheelchair brake kit of claim 12 wherein the parking brake assembly consists of a lever assembly, a toggle clamp assembly, a mounting assembly and a braking surface capable of engaging with a wheelchair wheel.

14. An improved anti-rollback wheelchair consisting of two mirror image brake units, each unit comprising:

a housing cylinder body cap;

a housing cylinder body;

a housing cylinder mounting assembly which is connected to the housing cylinder body;

a wheelchair mounting assembly which connects the housing cylinder mounting assembly to a wheelchair frame;

an anti-rollback, one-way, brake assembly;

a rotatable toggle clamp lever assembly which extends from the housing cylinder body cap in an ergonomic manner and controls the position of the anti-rollback, one-way brake assembly so as to prevent the wheelchair from moving forward, backwards or in either direction; and a toggle clamp assembly for engaging the anti-rollback, one-way, brake assembly with a wheelchair wheel wherein the toggle clam direction selection lever drives a toggle mount sleeve which is slidingly positioned inside the housing cylinder body and connected to the anti-rollback, one-way brake assembly to engage the anti-rollback, one-way, brake assembly with a wheelchair wheel.

15. The wheelchair of claim 14 wherein a parking brake assembly consisting of a lever assembly, the toggle clamp assembly, a mounting assembly and a braking surface capable of engaging with the wheelchair wheel is attached to at least one of the brake units.

* * * * *